US005185958A

United States Patent [19]

Dale

[11] Patent Number: 5,185,958

[45] Date of Patent: Feb. 16, 1993

[54] PROFESSIONAL CUTLERY SHARPENING MACHINE

[75] Inventor: Benton Dale, 425 Federal Ave., E., #A, Seattle, Wash. 98102

[73] Assignee: Benton Dale, Hood River, Oreg.

[21] Appl. No.: 599,731

[22] Filed: Oct. 19, 1990

[51] Int. Cl.[5] ..... B24B 7/00

[52] U.S. Cl. ..... 51/68; 51/69; 51/205 WG

[58] Field of Search ..... 51/68, 69, 216, 57, 51/59 R, 205 R, 205 WG, 211 R, 330, 331, 338-355

[56] References Cited

U.S. PATENT DOCUMENTS

| | | | |
|---|---|---|---|
| 308,046 | 11/1884 | Williams | 51/69 X |
| 2,191,899 | 2/1940 | Primak | 51/69 |
| 3,819,170 | 6/1974 | Longbrake | 51/69 |
| 4,216,627 | 8/1980 | Westrom | 51/69 |
| 4,441,279 | 4/1984 | Storm et al. | 51/69 |
| 4,512,112 | 4/1985 | LeVine | 51/69 X |
| 4,538,382 | 9/1985 | Johannsen | 51/69 |
| 4,731,953 | 3/1988 | Owen | 51/69 |

OTHER PUBLICATIONS

Benton Dale—Edge-Pro Instruction Manual, 23 pages—Date Mar. of 1990.

*Primary Examiner*—M. Rachuba

[57] ABSTRACT

A commercial grade cutlery sharpening machine of the hand-reciprocated type employs several novel features. Work-positioning is accomplished without the use of blade clamping structure by a pair of guide pins against which the back edge of the work is guided. An abrasive-material cartridge system is disclosed that allows rapid tool change. The tool holder includes a ramp and plastic stop that cooperate to allow full, even use of the abrasive material. The work table is adjustable in inclination for operator comfort and mounts readily by means of a common suction base.

7 Claims, 2 Drawing Sheets

PROFESSIONAL CUTLERY SHARPENING MACHINE

BACKGROUND OF THE INVENTION

The present invention relates to cutlery sharpening machines and more particularly to counter top mounted cutlery sharpening machines wherein the tool carrier is reciprocated by the hand of the user and is mounted in a swinging carrier. Furthermore, the machines in consideration employ a tool of an abrading nature.

The prior art for this invention is replete with methods of clamping the work during the abrading process. However, the geometry of this type of sharpener dictates that the tool carrier reciprocate in very nearly a straight line; otherwise the angle of abrasion will vary significantly. For these prior art machines to provide a consistent edge, the operator needs to constantly work the clamping mechanism open and closed as the work is progressed under the tool. This rapidly becomes tedious.

Prior art machines have been provided with means to adjust the height of the tool guide post to offer the operator a range of angle settings. The proper edge angle for a given piece of cutlery is a function of many factors: the material to be cut and the surface the edge must work against, among other considerations. Once the proper angle has been established and an initial quality edge has been formed, it is important that subsequent resharpening be done at the same angle.

The guide post of a typical machine is graduated for referencing this angle. For such a reference mark to be constant and absolute, geometry dictates that the edge of any blade, regardless of blade width, lie along an indicated reference line that is a fixed distance from the base of the guide post. Machines of the prior art have no clear indication of this reference line. Furthermore, the clamping structure employed in known machines will not accept a wide blade, such a meat cleaver, without the edge protruding far beyond the line used for angle referencing. This renders such a reference mark useless.

A further deficiency apparent in the prior art is characterized by the abrupt ends of the abrasive surface as it is presented to the work. Operators of these machines are inclined to work the abrading surface mostly in the middle to avoid these edges. This soon results in a concave stone face and consequent irregular sharpening angle. These machines will require stone replacement long before a machine conducive to full, even use of the abrading surface.

SUMMARY OF THE INVENTION

The present invention circumvents the geometrical limitations of work clamps as employed by the prior art by eliminating clamping structure entirely. It will be shown that a quality edge can be formed by constraining the work in only one degree of freedom, while allowing the operator to continuously progress the work under the sharpening tool. The constraining means can be as simple as a short pin, projecting out of the plane of the work rest, against which the back edge of a blade can be drawn to keep the edge along the predetermined reference line. In this manner the operator smoothly guides the work under the sharpening tool with one hand while reciprocating the tool with the other. When one side of the work has been sharpened, the tool and work switch hands and the blade is presented from the opposite side. Two guide pins are provided on the work receiving carriage to facilitate presentation of the work from either direction. Though the pin employed when sharpening from either side is slightly out of the direct line of force imparted by the tool, any rotational movement is easily countered by the hand, thereby imparting a feel for the edge being formed. This simple though unobvious system can consistently produce a hair-shaving edge.

The work carriage, upon which the guides pins are disposed, glides smoothly for and aft on the table and is fixable in position with a wing nut. In practice, the operator prepositions the carriage, aligning the edge to be sharpened just over, and parallel to the front edge of the table. The long travel of the carriage allows the sharpening of blades from pocket knife to meat cleaver width while maintaining the edge along this reference line. This arrangement allows the marking of a absolute angle as found by basic trigonometry, on the adjustable guide post.

The present invention also provides a novel means to encourage full, even use of the abrasive material. A thin spring steel ramp guides the abrading surface smoothly onto the edge at the beginning of the forward tool stroke and off the edge at the finish of the aft stroke. A durable plastic stop terminates the forward stroke and serves as a safety for the operator's hand.

The abrasive tool disposed in the tool holder is readily removeable to facilitate change of abrasive grade or for replacement of a worn stone. The invention provides a cartridge system wherein stones of at least two different abrasive grades are supplied. Each stone is bonded to an aluminum support plate that readily snaps in and out of the tool carrier.

I have found the best abrasive material for this application to be aluminum oxide and the best lubricant to be water. Water carries away abrading residue, thus preventing the pores of the stone from clogging, and is much easier to clean up than oil.

The present invention further provides for an ergometrically adjustable table that readily and unobtrusively mounts to a counter-top or like surface.

In light of the limitations of the prior art, it is an object of the present invention to provide a cutlery sharpening machine free from cumbersome clamping structure.

It is a second object of this invention to provide a tool carrier structure conducive to full, even use of the abrading surface.

It is a third object of this invention to provide an abrasive-material cartridge system for inexpensive replenishment of a thoroughly worn abrading tool and for rapid interchange of abrading tool grades.

It is a further object of this invention to provide a positive and steady work guiding structure that will accommodate a wide range of cutlery blade widths while maintaining accurate edge-angle reference geometry.

It is yet another object of this invention to provide work support table that unobtrusively fastens to a counter top or similar surface and is adjustable in inclination for ergometric reasons.

It is an additional object of this invention to provide a simple, reliable, commercial quality precision cutlery sharpening machine.

The above and additional objects and advantages will become more apparent when taken in conjunction with the description and drawing of the preferred embodiment of the invention.

DESCRIPTION OF THE PREFERRED EMBODIMENT

Figure 1:
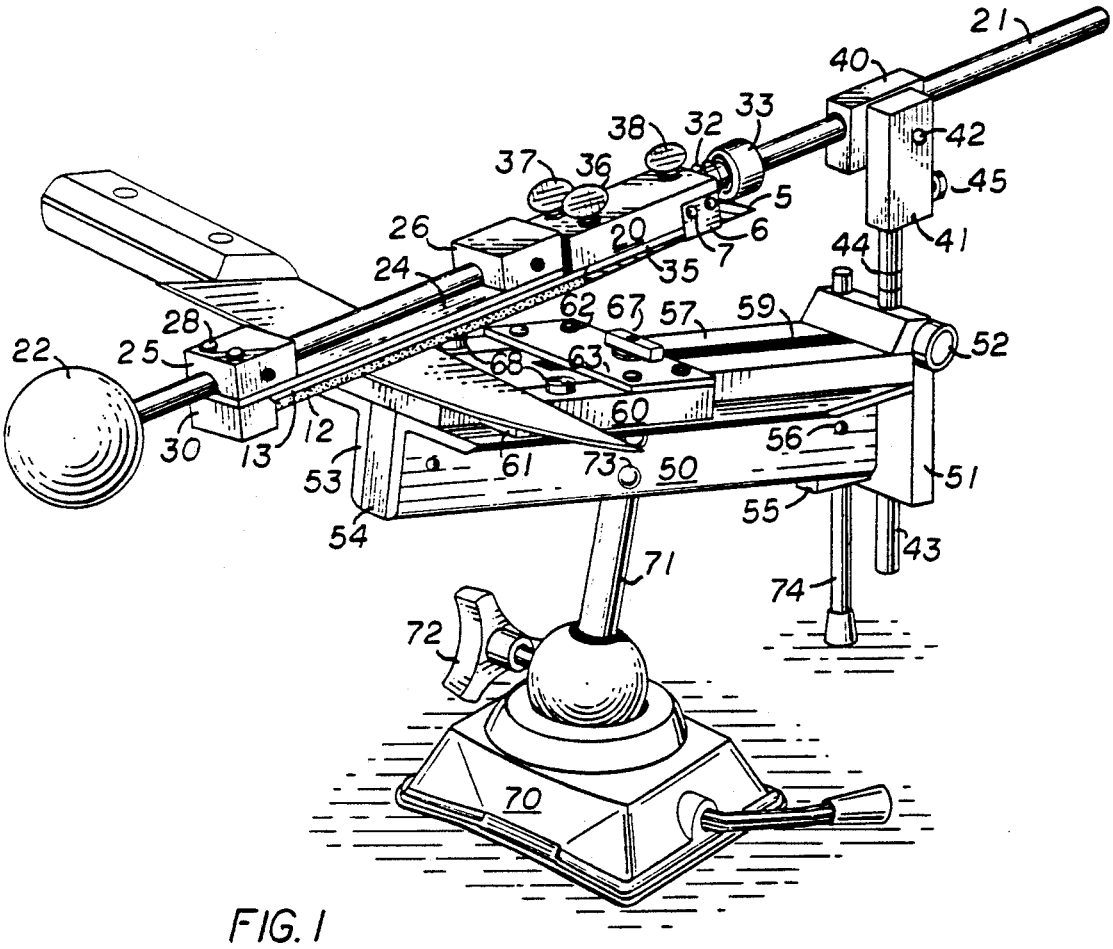
FIG. 1 is a perspective drawing of the preferred embodiment.
Figure 2:
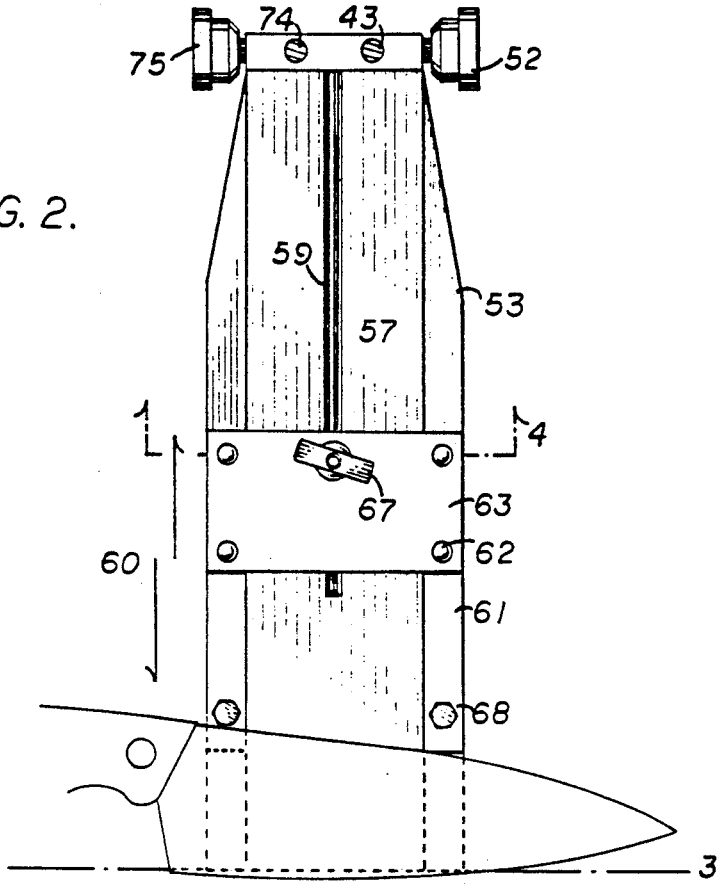
FIG. 2 is a top view of the table assembly illustrating the work guiding means and angle referencing line 3.
Figure 3:
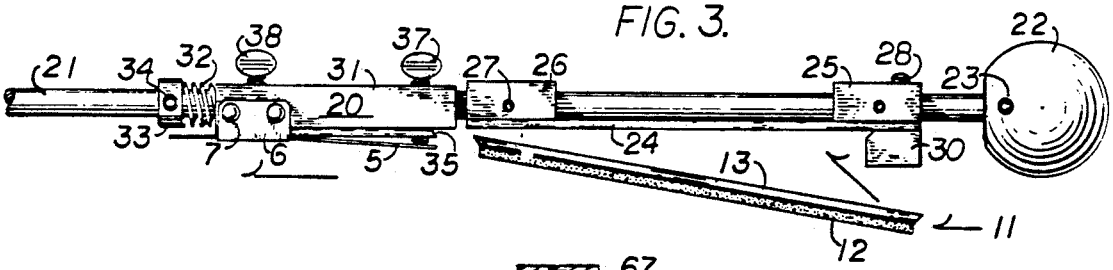
FIG. 3 is a side view of the tool holder illustrating the removable cartridge system.
Figure 4:
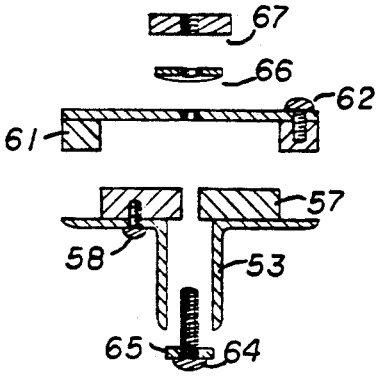
FIG. 4 is a cross section of the table assembly taken across line 2 in FIG. 2.

Referring to the drawings in detail; wherein the same reference characters designate corresponding parts throughout the different views, the number 10 indicates the present improved sharpening machine.

Abrading cartridge carrier 20 is built around guide rod 21 which terminates in a ball-shaped handle 22, secured by means of clevis pin 23. Platen 24 is secured to guide rod 21 by means of two blocks 25 and 26 having both formed thereon a u-shaped groove to closely fit guide rod 21. Blocks 25 and 26 are fixed to guide rod 21 by means of pins 27. Two screws 28 penetrate block 25, continue through the platen 24 and terminate in edge-guard block 30; thereby fixing block 30 strongly to the above assembly. Edge-guard block 30 is machined from a strong, resilient material such as UHMW plastic or the like, that will not damage a fine edge. Edge-guard block 30 serves as a positive stop means for the abrading stroke as well as a safety means by preventing the abrading cartridge carrier from riding over the blade.

Edge guard block 30 is angularly notched to receive one end of an abrading cartridge 11. A cartridge 11 is composed of a layer of abrasive material of predetermined fineness 12 adhesively bonded to a support layer 13 of aluminum plate or the like. Both ends of support layer 13 project beyond the extent of the abrasive material 12 as angled protrusions for retention in abrading cartridge carrier 20.

The other end of an abrading cartridge 11 is received by an angular notch in ramp block 31. Ramps mounting block 31 is drilled through to slide smoothly on guide rod 21 and is biased by spring 32 working against spring stop collar 33 that is fixed to guide rod 21 by means of setscrew 34. Ramp mounting block 31 is of a material compatible as an unlubricated bearing couple with guide rod 21 such as UHMW plastic or the like. Plate 35 is secured to the underside of ramp mounting block 31 and is threaded to receive three thumb screws 36, 37, and 38 for purposes set forth below. Spring steel ramp 5 is disposed below block 31 and serves as a smooth transition for the work onto the abrading surface. Ramp 5 and edge guard block 30 cooperate to allow the operator a long, smooth stroke, free from worry of "falling off" the abrading surface. Ramp 5 is slidably retained by band 6 which is of durable thin metal and is retained by four screws 7 into block 31. Thumbscrew 38 serves to lock ramp 5 in a horizontal position while thumbscrew 36 and 37 are employed to maintain the vertical deflection of ramp 5 flush with the abrading surface.

Guide rod 21 is slideably received by block 40, also of UHMW or the like that is further pivotally mounted to block 41 by means of pivot bolt 42. The downward swing of block 40 is limited by a stop (not shown) to ensure retention of the tool carrier if it is swung horizontally clear of the table. Block 41 is journalled to receive pivot post 43. Stop-screw 44 of nylon or the like provides adjustable resistance to the swing of the tool carrier about a vertical axis to encourage a nearly reciprocal tool motion. This friction coupling also serves to dampen vibrations in the system during the stroke. Pivot post 43 is incrementally marked along a portion of it's length to indicate angle of abrasion. These marks 44 may be color coded or labeled in any angular measure. Marks 44 are to be aligned with a fixed point such as the top surface of table end plate 51. Pivot post 43 is slideably received by table end plate 51 and is held in it's desired position by knob 52.

Table 50 is built around two lengths of angle section 53 of aluminum or the like. Spacing blocks 54 and 55 are disposed between angle sections 53, one flush with each end and riveted through by rivets 56. The linear extent of blocks 54 and 55 is such as to leave a void between angle sections 53 for purposes to be set forth below. Table deck 57 of UHMW or the like is screwed to the top surface of the angle sections 53 by means of screws 58, from below. Table deck 57 is provided with a slot 59 for most of it's length for purposes also set forth below. Table end plate 51 is secured to table 50 by means of three screws (not shown), one into the vertical face of spacer block 55 and the other two in the vertical edge of table deck 57.

The table 50 slideably receives blade carriage 60. Blade carriage 60 is composed of two bar-shaped runners 61, of UHMW plastic or the like, each fixed by screws 62 to plate 63, thereby forming a rigid removable carriage assembly capable of sliding the length of table 50. Plate 63 is provided with an aperture to allow passage of a bolt 64, through slot 59 in table deck 57. Bolt 64 is provided with a rectangular washer 65, disposed below table deck 57, (in the void between angle sections 53), and washer 66 and wing nut 67 disposed on the upper surface of plate 63. This arrangement allows the operator a simple, quick means to preposition blade carriage 60 along table deck 57.

Runners 61 are provided with blade edge engaging pins 68. In this preferred embodiment these pins are simply hex-head screws turned flush with the runner surface. Pins 68 serve to guide the back edge of the work as it is progressed under the abrading tool. Pins 68 further serve to indicate to the operator the horizontal extent of the recommended sharpening zone.

Table 50 is primarily supported by a lever-actuated suction base 70. Such bases are know in the fastening art and a detailed description of its function is not within the scope of this invention. Base 70 allows pivotal motion of leg 71; the desired angle being secured by hand knob 72. Leg 71 terminates in the void between angle sections 53 and is securely bolted through by bolts 73. Table 50 is further steadied by leg 74 slideably received by table end plate 51. Knob 75 locks leg 74 at it's desired protrusion length. Base 70 and leg 74 cooperate to form a simple unobtrusive mounting means for the machine 10 and further allow the operator means to adjust the inclination of the machine 10 for ergometric reasons.

As the detailed operation of the machine has been disclosed throughout the specification, no further discourse is necessary. It is to be understood that the invention need not be limited to this preferred embodiment and that significant variations in structure can be anticipated without departing from the scope of the invention.

I claim:

1. A cutlery sharpening machine of the type that includes a hand reciprocated tool carrier slideably received by a pivot means disposed at the upper terminus of a post means, said tool carrier provided with a tool of an abrading nature, said post adjustably and fixable received by a table means to thereby vary the angle of disposition of the tool carrier relative to said table means, said angle being indicated by a reference scale marked on the post means, a work positioning means disposed on the table means wherein the improvement comprises:

an abrading tool cartridge system for said machine comprising at least one abrading cartridge, the cartridge composed of a planar layer of abrasive material of predetermined thickness and abrasive grade, a rigid support member of substantially same planar dimensions as the abrasive material piece, said rigid support member having at least two protrusions beyond the planar lines of the support member, and receiving means disposed within the tool carrier to mate with said protrusions, further including:

at least one work guiding surface for the abrading tool comprising a ramp shaped surface adjustably and fixedly retained to at least one of said receiving means and proximate at least one edge of an abrasive tool working surface, said ramp means fixable in horizontal and vertical displacement relative to said abrasive tool working surface to thereby smoothly guide the edge being formed on and off the abrasive tool surface during reciprocating work strokes.

2. The machine of claim 1 further including a blade stop means formed of a rectangular block of plastic fastened to said tool carrier and having one surface of the block adjacent and perpendicular to one edge of said abrasive material piece to thereby act as a terminating point for forward tool strokes and consequent starting point for aft tool strokes.

3. The machine of claim 2 wherein said blade stop means provides one of said receiving means for said tool cartridge.

4. The machine of claim 1 wherein the work guiding ramp is a rectangular sheet of thin-gauge spring steel.

5. The machine of claim 1 wherein at least one of the tool cartridge receiving means is spring biased toward the second receiving means whereby said tool cartridge is positively retained and readily removed.

6. The machine of claim 1 wherein said rigid support member for said abrasive material piece is of aluminum plate.

7. The machine of claim 1 wherein said abrasive material piece is of aluminum oxide.

* * * * *